United States Patent [19]

Sampson

[11] Patent Number: 4,476,380

[45] Date of Patent: Oct. 9, 1984

[54] CALCULATOR

[76] Inventor: Lorne G. Sampson, 863 E. 166th St., South Holland, Ill. 60473

[21] Appl. No.: 337,540

[22] Filed: Jan. 7, 1982

[51] Int. Cl.[3] ..... G06C 3/00

[52] U.S. Cl. ..... 235/61 B; 235/70 B; 235/89 R; 235/127

[58] Field of Search ..... 235/61 B, 61 D, 61 GM, 235/70 B, 89 R, 123, 124, 127, 69; 33/1 R

[56] References Cited

U.S. PATENT DOCUMENTS

| | | | |
|---|---|---|---|
| 1,864,056 | 6/1932 | Frankel | 235/89 R |
| 2,699,894 | 1/1955 | Hirsch | 235/61 B |
| 3,333,767 | 8/1967 | Daggett et al. | 235/61 B |
| 4,037,084 | 7/1977 | Seirey et al. | 235/69 |

*Primary Examiner*—Benjamin R. Fuller
*Attorney, Agent, or Firm*—Eugene F. Friedman; Solomon J. Lehrer

[57] ABSTRACT

A calculator of flat design with a surface chart showing marginal scales and diagonal inner ones. The top of the calculator serves as a cover attached marginally to a case underneath. Also, the top has a diagonal slot, and is surmounted by a flat pointer which has a similar slot, and can be slid and rotated to relate to numerical values in the scales. An axial post is installed to pass through and be movable to any desired point in the slots, with means disengaging the post by finger pressure for movement away from said point.

3 Claims, 6 Drawing Figures

FIG. 1
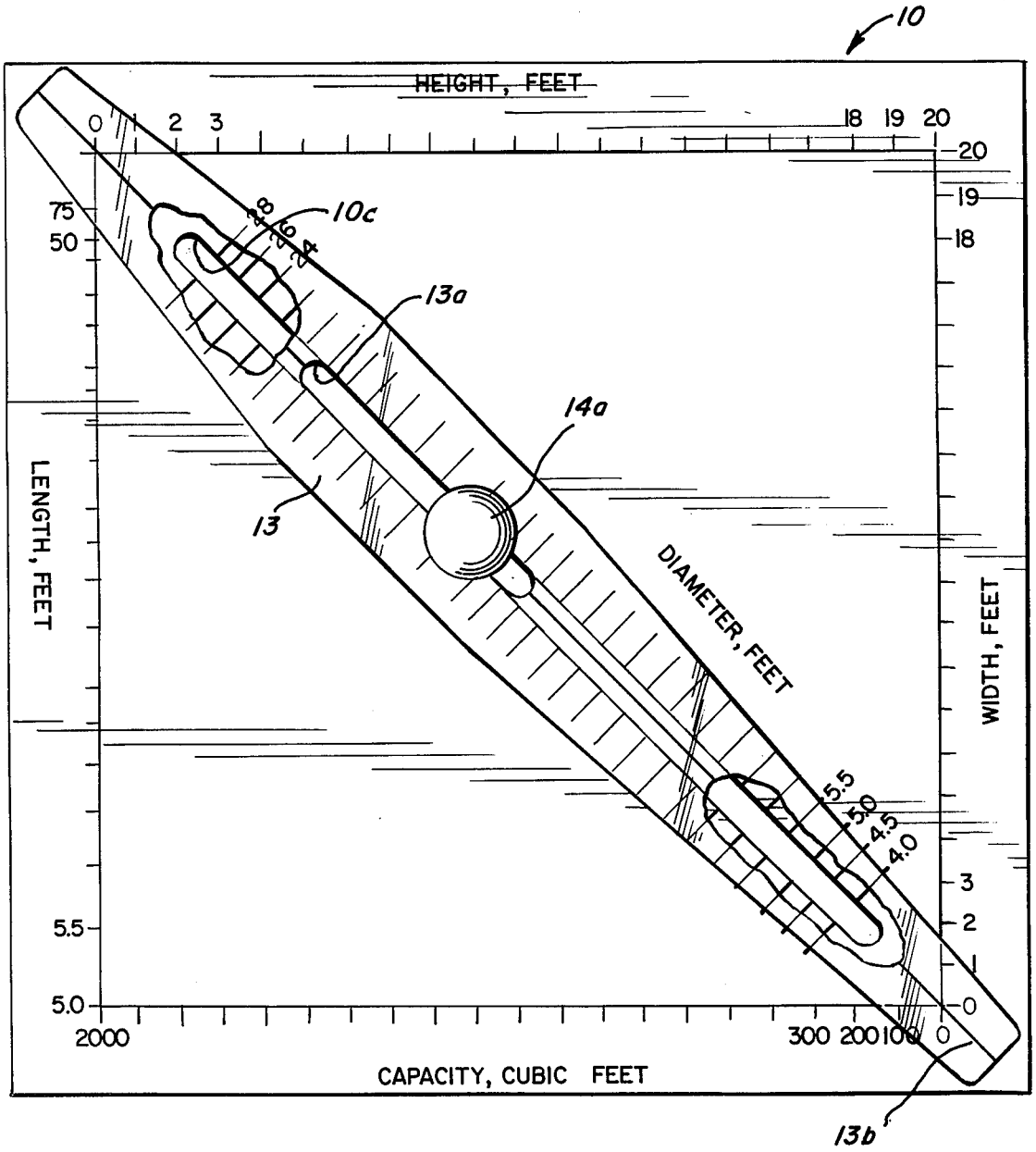
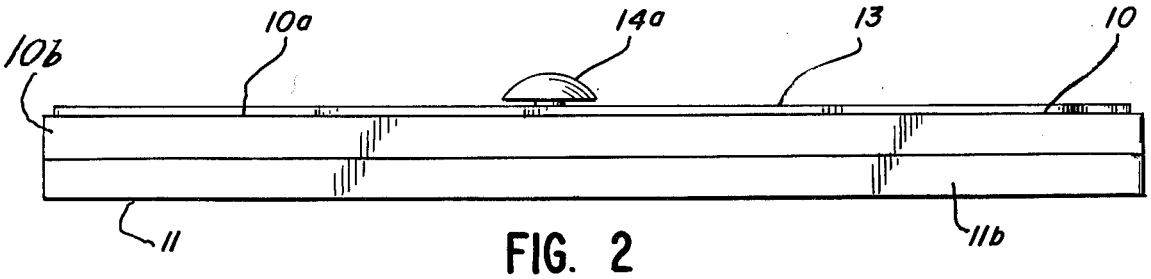
FIG. 2

CALCULATOR

This invention relates to nomographs, and one of its objects to put a nomograph into a complete mechanical form.

A further object is to provide an instrument of the above character which is in one piece, with moving parts closely assembled.

A still further object is to design an instrument with a chart of scales on its face, and an arrangement to exactly position or register their values for alinement with the mechanical features of the instrument.

Another object is to provide an instrument of the above character with scales useable for calculating equations, the latter and the scales being programmed, so that all calculations will be related.

With the above objects in view, a better understanding of the invention may be gained by reference to the accompanying drawings, in which:

FIG. 1 is a top view of the calculator approximately full size, with portions of a pointer broken away;

FIG. 2 is a front edge view;

FIG. 5 is a view similar to FIG. 4, with positions of the said portions altered; and FIG. 6 is a section on the line 6—6 of FIG. 4 with a partial view of the bottom component.

Referring specifically to the drawings, the calculator is in the form of a shallow box composed of its main component—a cover 10—and a case 11 for the same, these parts appearing as in FIG. 2 when assembled. The cover is mainly a top 10*a*, and one of a variety of numerical charts suitable for solving nomographical problems.

Figure 3:
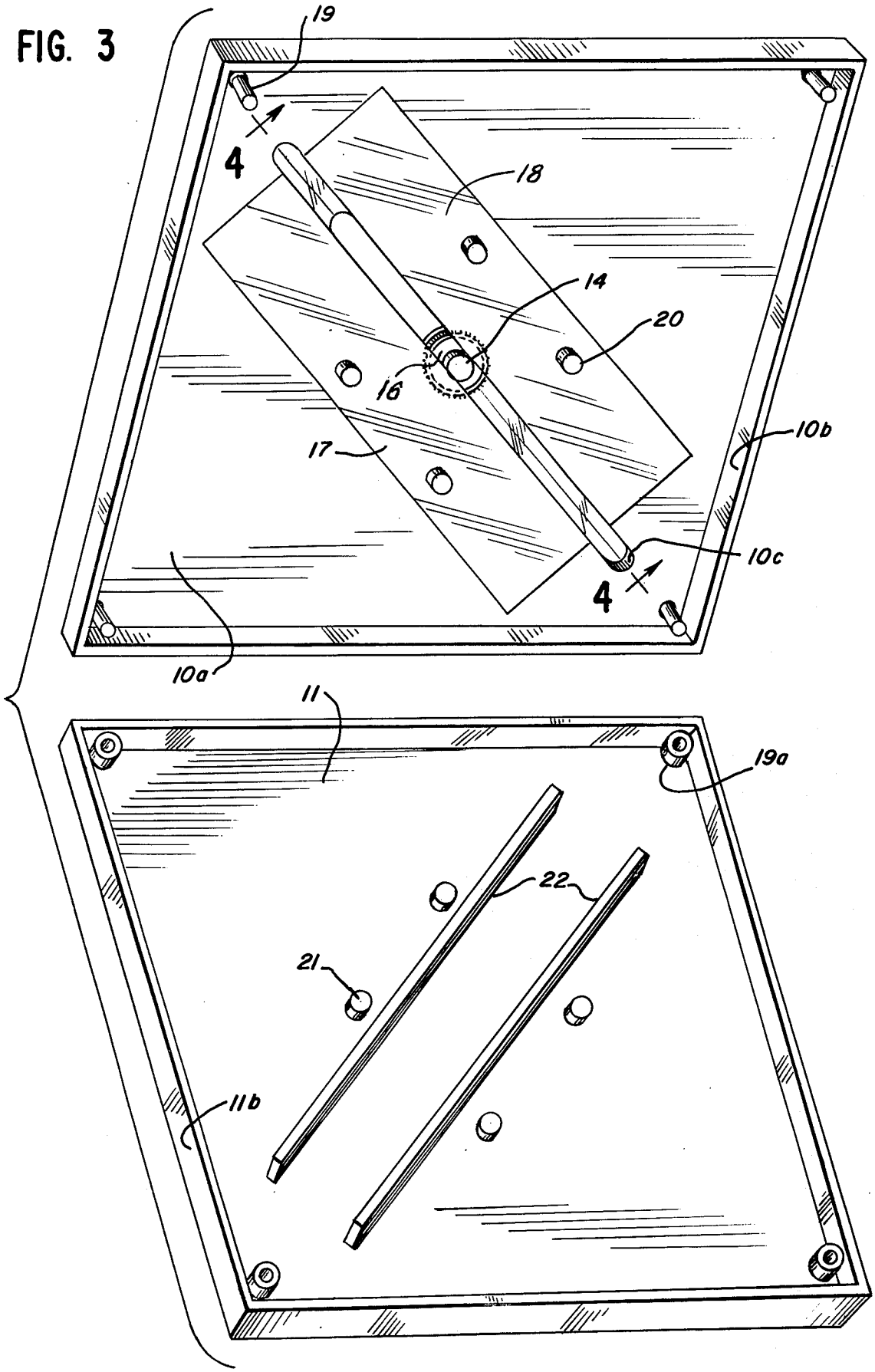
FIG. 3 is a perspective view of the calculator with its top and bottom components taken apart and viewed from the inside.

The cover and case are of hard plastic substance; and they have marginal rims 10*b* and 11*b* which meet in abutting relation as seen in FIG. 2 to close the cover on the case. These parts are then cemented together. For a clear view of their inner sides the cover appearing as in FIG. 2 may be raised from the front, so that it and the case will appear on the inside as in FIG. 3.

The cover top 10*a* is cut with a long diagonal slot 10*c*, and receives a double-ended transparent pointer 13 over the slot; and the pointer is made with a shorter slot 13*a* over that of the cover, and marked with a line 13*b* centered from the ends of its slot. The cover slot 10*c* is provided because it corresponds to the mathematical function of a nomograph; and the pointer slot 13*a* enables the pointer to be used at any position of an axial post about to be mentioned, with a minimal length of the pointer.

Figure 4:
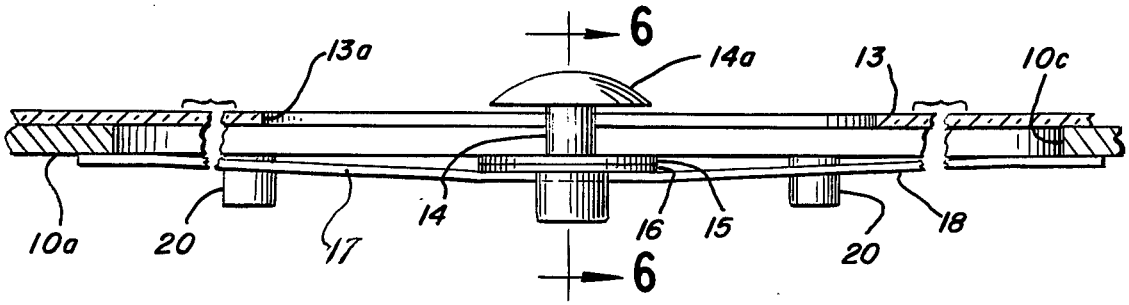
FIGS. 4 to 6 are magnified to double size, FIG. 4 being a section of the line 4—4 of FIG. 3, with some portions in original positions.

The axial post is shown at 14, and assembled with the top and pointer through their registering slots. As seen in FIG. 4, the post has a domed head 14*a* over the pointer and an enlargement under the top 10*a*, first as a frictional washer 15 and next as a circular disc 16.

The axial post 14 is kept in place at any point where it may be moved along the top slot 10*c*. This is done by upward pressure against the disc 16 to engage its washer 15 frictionally with the under side of the top 10*a*.

Figure 6:
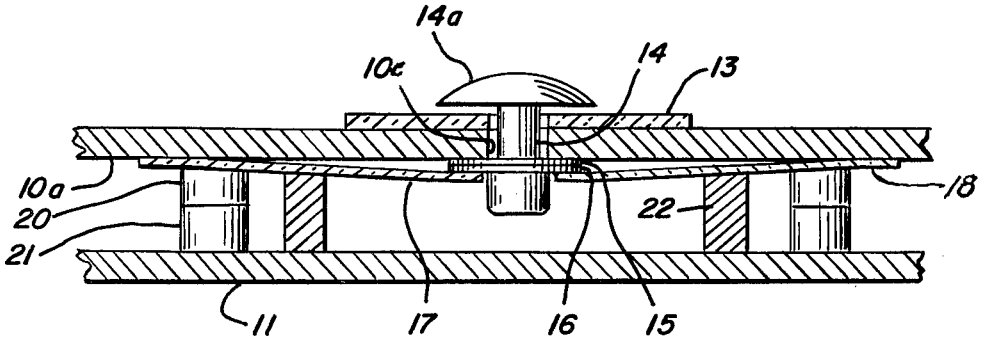

Such pressure is exerted at all times by a pair of spring sheets 17 and 18 applied from underneath to the disc on opposite sides of the post, as seen in FIG. 6; and FIG. 4 shows that the outer edges of the spring sheets are pressed against the cover by means soon to be described.

Figure 5:
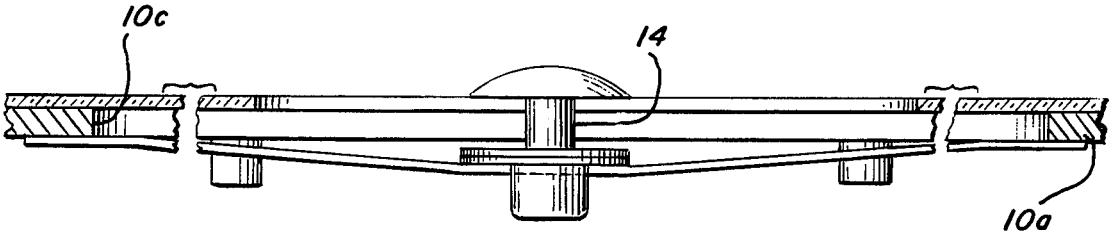

Numerical markings, such as marginal and diagonal scales, on the cover chart are designed to combine in desired relation by sliding and turning the pointer 13 accordingly, while the axial post 14 is in related position along the slots 10*c* and 13*a*. However, for fixed relationships the combination of markings requires that the post 14 be set in a specific position along the slots. Finger pressure on the head 14*a* of the post will space its washer 15 from the under side of the cover, enabling the post to be slid to any desired position. It is noted that the spring sheets are almost as long as the slot 10*c* to keep the post raised at any point along the slot. Whether the axial post is up—as seen in FIG. 4—or depressed—as seen in FIG. 5—sufficient clearance is present under its head 14*a* for the pointer to be slid or rotated as desired.

It is important that the cover 10 and case 11 be assembled with accuracy and reinforced to withstand external pressure tending to deform parts on the inside. The first requirement is met by a series of studs 19 integral with and projecting from within the corners of the top 10*a* to fit similarly-formed sockets 19*a* inside the corners of the case 11 when the cover and case are assembled. The second safeguard consists of a set of studs 20 descending from the cover top 10*a* through the spring sheets 16 and 17—to meet similarly-arranged studs 21 rising from the case 11. The studs function to fix the positions of the spring sheets. Also, only one spring sheet may be used if desired. The case 11 also has a pair of diagonal ribs 22 rising to urge the spring sheets against the disc 16. Only one such rib may be employed.

A simple example for the use of the present calculator will now be presented to foretell use with a variety of mathematical functions differing in complexity. Thus, the problem is to determine a set of convenient dimensions for a bin which is to have a capacity of 1440 cubic feet. If 18 feet of height are first chosen as one convenient dimension, the center line of the pointer is set in a position which alines the scale point indicating the height of 18 feet and the point indicating a capacity of 1440 cubic feet on the opposite scale. This fixes the axial post 14. This position of the axial post, if the diagonal slot would have been scaled, would indicate 80 square feet of bin floor area. Now the pointer is turned, with the axial post fixed, to aline with a selected convenient bin length of 10 feet. As held, the opposite end of the pointer shows, on the opposite scale, a bin width of 8 feet which satisfies the requirement for a practical width dimension to be used with the two chosen dimensions.

It is now apparent that the novel calculator presents a combination of factors handily positioned on the surface of the calculator and simply adjustable as mentioned to assume a relation in combination with other values marked on the chart—to function as a nomograph; and the main advantage of the calculator is to do away with the handling of straight edges and markers incident to nomographs. Finally, the novel calculator is quite simple; and its flat form makes it very compact.

I claim:

1. A calculator having a top, a surface chart on the latter marked with marginal and diagonal scales usable for nomographic calculations, said top containing a diagonal slot, a double-ended pointer above said chart having a longitudal centerline and a slot registering with said center line and the top slot when the pointer is rotated to match the diagonal direction of same, an axial post having a head passing through both slots and being slidable therein, the axial post having an enlargement underneath said top surface with a friction washer, and means bearing on the enlargement from underneath to hold said washer in engagement with the under surface of said top along its slot and check the axial post from lateral movement while maintaining said post head spaced above said chart, said pointer being slidable along said top slot and rotatable about said post to balance values in said scales in keeping with a desired numerical equation.

2. The structure of claim 1 wherein manual depression of said head lowers the enlargement and washer and frees the post for sliding movement in either or both of said slots.

3. The structure of claim 2 wherein said means bearing on the enlargement comprises a spring sheet on at least one side of the axial post and extending along the underside of said top.

* * * * *